United States Patent [19]

Scholl

[11] Patent Number: 4,513,677

[45] Date of Patent: Apr. 30, 1985

[54] METHOD AND DEVICE FOR SAFE OPERATION OF AN AUTOMATIC SEWING MACHINE

[75] Inventor: Hans Scholl, Oerlinghausen-Lipperreihe, Fed. Rep. of Germany

[73] Assignee: Koch Adler AG, Bielefeld, Fed. Rep. of Germany

[21] Appl. No.: 485,646

[22] Filed: Apr. 18, 1983

[30] Foreign Application Priority Data

May 3, 1982 [DE] Fed. Rep. of Germany ..... 3216529
Sep. 25, 1982 [DE] Fed. Rep. of Germany ..... 3235576

[51] Int. Cl.[3] ..... D05B 21/00

[52] U.S. Cl. ..... 112/262.3; 112/121.12; 112/121.14

[58] Field of Search ..... 112/262.3, 262.1, 121.12, 112/121.15, 121.11, 2, 158 E, 121.14

[56] References Cited

U.S. PATENT DOCUMENTS 4,289,084 9/1981 Takenoya et al. ..... 112/158 E
4,336,761 6/1982 Magnan ..... 112/121.12

FOREIGN PATENT DOCUMENTS

WO82/04077 5/1981 PCT Int'l Appl. ..... 112/121.15

*Primary Examiner*—Peter Nerbun
*Attorney, Agent, or Firm*—Max Fogiel

[57] ABSTRACT

Method and device for safe operation of an automatic sewing machine having a programmable computer controlling a seam contour, at which a contoured workpiece clamp is automatically identified and compared with the sewing contour prior to the start of the sewing operation. The method also may include a further subroutine for automatically positioning the controlled seam contour with respect to the workpiece clamp so as to eliminate an accumulation of errors resulting in damaging of the automatic sewing machine. According to this invention a sewing head is provided with a sensor, which is moved along a distance limited by a firm reference point and a trigger point arranged at the workpiece clamp, where the detected distance corresponds to the profile of the workpiece clamp.

12 Claims, 8 Drawing Figures

Fig. 1
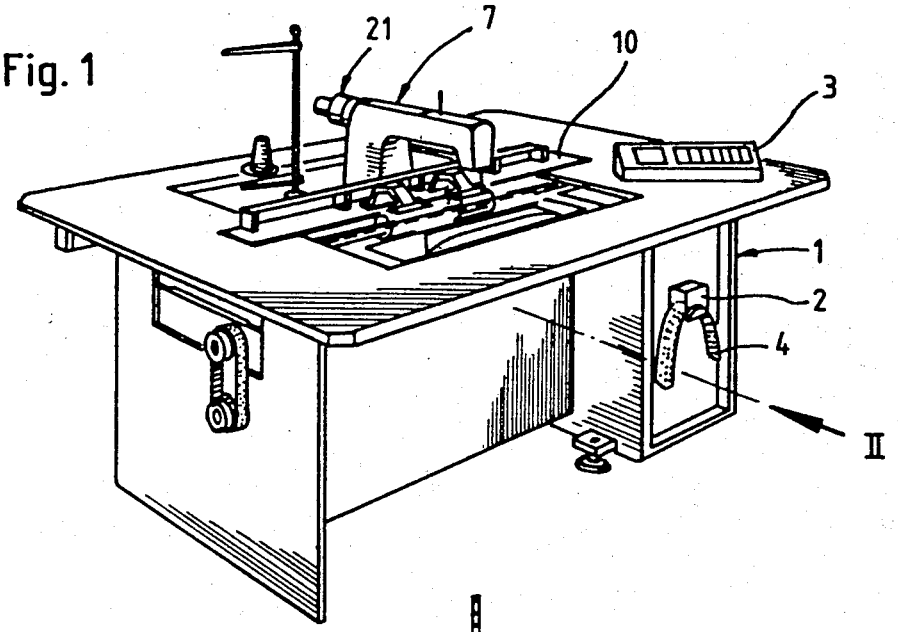
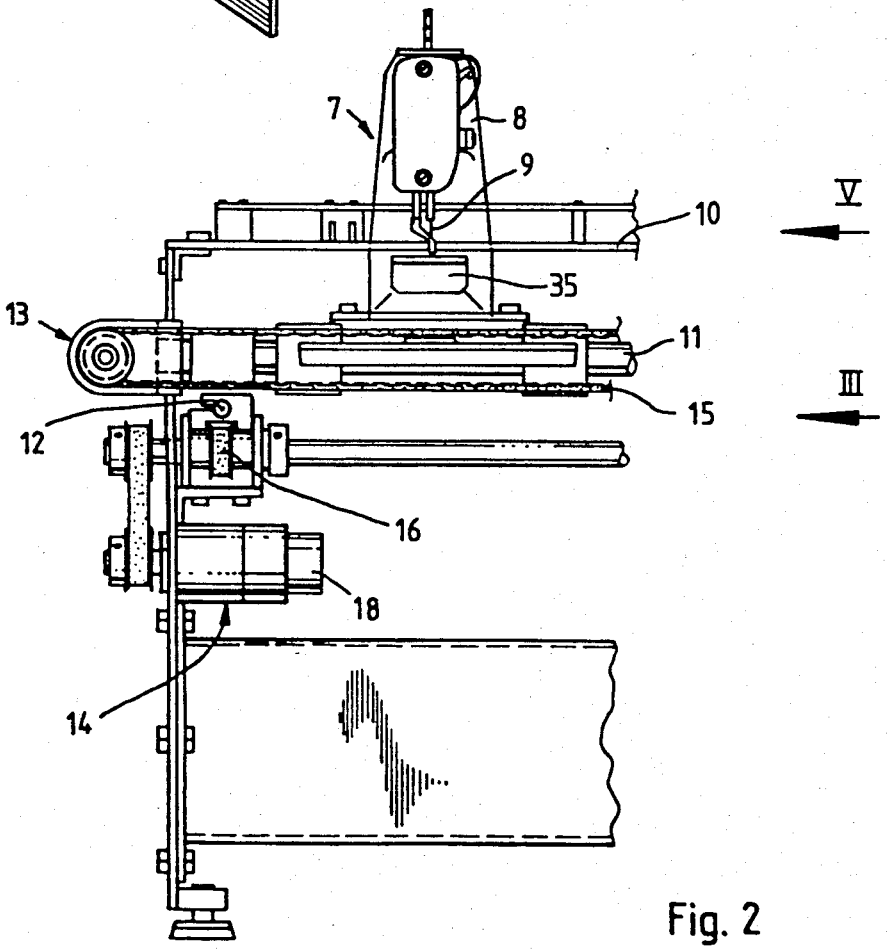
Fig. 2

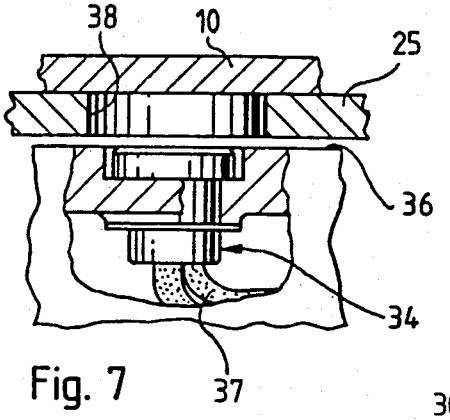
Fig. 7
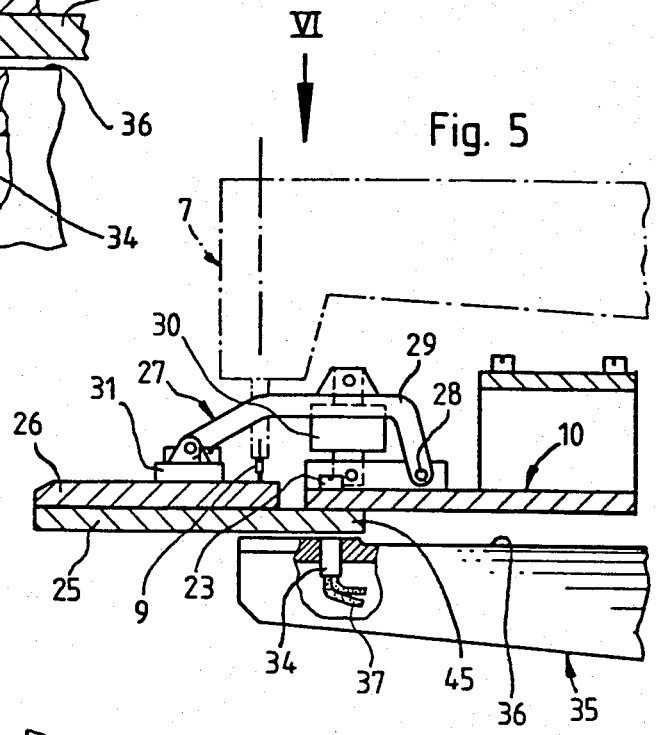
Fig. 5
Fig. 6
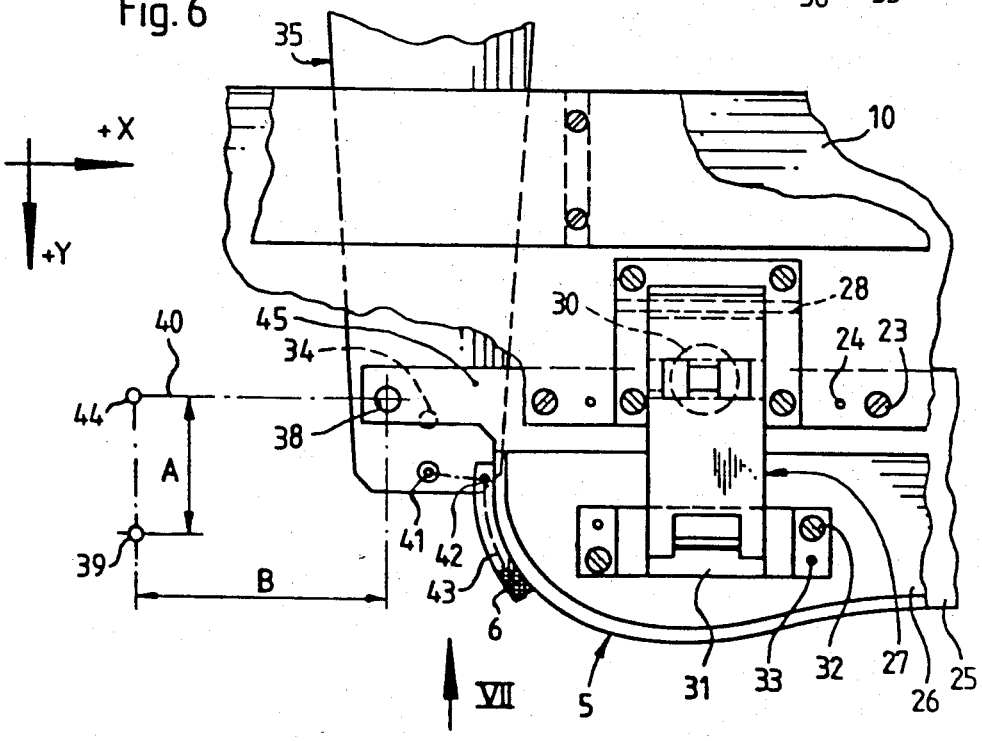

METHOD AND DEVICE FOR SAFE OPERATION OF AN AUTOMATIC SEWING MACHINE

BACKGROUND OF THE INVENTION

The present invention relates to an automatic sewing machine, in which a relative movement between a workpiece and a sewing head is controlled by a computer receiving a program according to a predetermined contour to be stitched. In particular, this invention relates to a method and a device for protecting an automatic sewing machine of the aforesaid character from damage from collision between the sewing head and the workpiece clamp.

In such CNC-controlled sewing machines an individual sewing contour is given by a program stored on a data carrier, e.g. a punched tape or an EPROM-cassette into the computer. The contour represents the path of the needle with respect to the workpiece. The contour is determined by perpendicular coordinates of some significant points, which form the variables of an algorithm applied for figuring all required values of a contour by using linear or square interpolation. Thus, by the input of such significant points the basic profile of the contour is determined. Furthermore, it is required that the workpiece clamp is formed with a profile that is matched to the contour controlled by the computer. In case of an implementation of a workpiece clamp that does not fit to the programmed contour, the sewing head of the sewing machine or the workpiece clamp and under particular circumstances the drive motors will be damaged. Therefore, it is necessary to check the matching of an inserted workpiece clamp with the computer-controlled contour prior to initiating a sewing process. Since this checking procedure should be performed in a minimum of time on one hand and mis-operation on the other hand must be eliminated, it has proved necessary to automatically perform this control procedure prior to the sewing process, and to carry out the control without any action from the operator.

In a known automatic sewing machine there are four microswitches which cooperate with exchangeably contoured workpiece clamps. After the installation of a certain workpiece clamp, a characterizing shift status is indicated by the switches which are being read and compared by the computer with the loaded program. Only after this checking procedure can the sewing process be initiated as far as both, the loaded program and the workpiece clamp show an associated contour. Indeed, with this known application of a number of switches for identifying a workpiece clamp, a damaging of the automatic sewing machine caused by mis-operation is eliminated. However, it is necessary to install a plurality of switches including wiring, which is costly. Due to the physical extension of such switches the number of identification codes is limited to the number of sixteen, with four switches.

Another shortcoming in the operation of such sewing machines is known from the fact that the actual sewing contour may deviate from the theoretically programmed contour. Such uncontrolled deviations which itself may be of minor extent can, by accumulation, also lead to a collision between the sewing head and the workpiece clamp.

Accordingly, the main object of the present invention is to provide a method to prevent the expensive item of equipment such as an automatic sewing machine from damage from collision of the sewing head and the workpiece clamp. Therefore, a method is provided for safe operation of an automatic sewing machine to automatically carry out a checking procedure with respect to the contour of the workpiece clamp and the contour controlled by the computer by using already existing components of the computer.

Another object of the present invention is to carry out the foregoing method so that the movably arranged sewing head is moved out of the way for making possible the exchange of the workpiece clamp.

Still a further object of this invention is to provide a device of simple construction for carrying out the aforesaid method in which contoured workpiece clamps include low-cost rigid code elements for identification.

Still a further object of the present invention is to provide a device for carrying out the aforesaid method in which the number of identification codes for differently contoured workpiece clamps is inexpensively increased.

Still another object of this invention is to provide a device of the aforesaid type which is reliable in operation.

A further object of this invention is to include an alignment procedure in the afore-described method, in which errors arising during the operation of the machine are automatically corrected.

SUMMARY OF THE INVENTION

The preceding objects are achieved by a method for identifying the inserted particularly contoured workpiece clamp and automatically comparing the identified workpiece clamp with the loaded program prior to the release of machine operation. A sensing device is arranged at the movable sewing head and moved on a straight line situated in the sewing area in the range of the mount base of the contoured workpiece clamp for sensing an edge arranged at the mount base. The distance between the edge to be sensed and a stationary reference point represents a code for identifying the inserted individually contoured workpiece clamp. Furthermore, the method does not necessarily require the reference point being placed on the above-described straight line. In this case, the sewing head at first is moved on a path as a firm part besides the programmed contour until the straight line for workpiece clamp identification is detected by the sensing device. As a result of the recognition of a corresponding contour, the computer automatically moves the sewing head to the starting point of the seam to be produced.

With the implementation of a subroutine the sewing head movement is controlled by the computer so as to automatically carry out an alignment procedure with respect to a contour offset. Thus, an accumulation of errors leading to unacceptable offset stitch contours and the possibility of self-damaging of the sewing machine is eliminated.

In accordance with the present invention a device for carrying out the above-described method is provided, in which the sensing device, installed at the movable sewing head, cooperates with a punctiform trigger edge formed at the mount base of the contoured workpiece clamp to be identified. By forming the trigger edge as a bore, a rigid construction is achieved. The arrangement of the sensing device at the sewing head allows the use of only one sensing element although the number of identification codes is increased. Thus, low cost identification is achieved.

Other objects, advantages and features of the present invention will appear from the detailed description of the preferred embodiment which will now be explained in connection with the accompanying drawings.

BRIEF DESCRIPTION OF THE DRAWINGS

FIG. 1 is a perspective total view of an automatic sewing machine;

FIG. 2 is a partial front plan view of the automatic sewing machine in the direction of the arrow II in FIG. 1;

FIG. 5 is a sectional view in the direction of the arrow V in FIG. 2;

FIG. 6 is a partial top plan view in the direction of the arrow VI in FIG. 5;

FIG. 7 is a partial sectional view of the sensor area in the direction of the arrow VII in FIG. 6.

DESCRIPTION OF A PREFERRED EMBODIMENT

Figure 3:
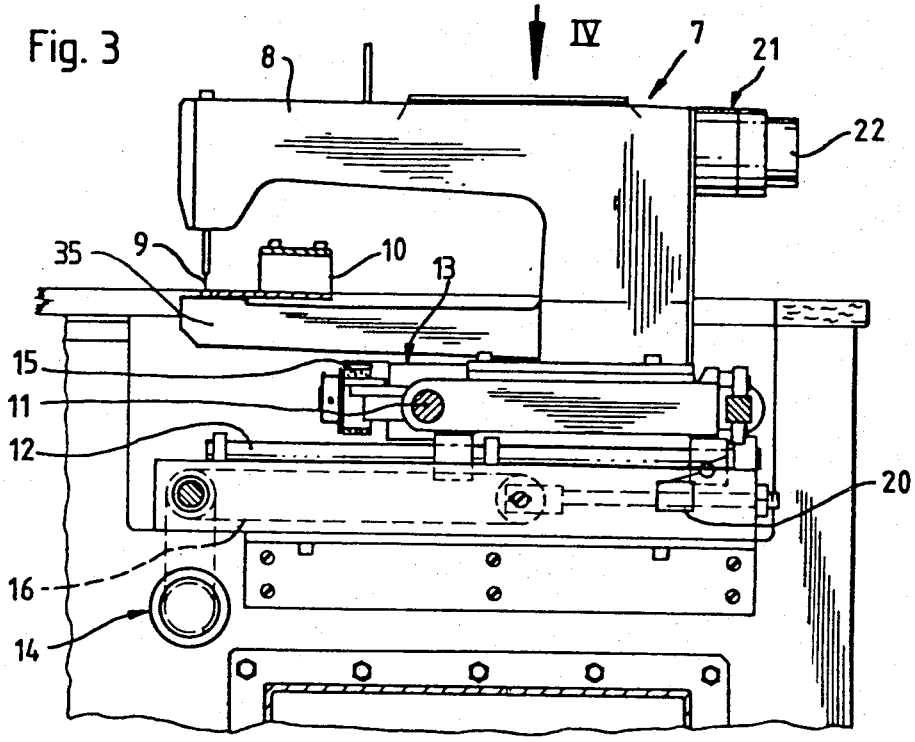
FIG. 3 is a partial side view of the automatic sewing machine in the direction of the arrow III in FIG. 2.

The automatic sewing machine according to FIG. 1 is controlled by a computer 1 having a tape reader 2. The functions of the computer 1 are manually initiated by means of a control panel 3. Prior to a sewing cycle, the tape reader 2 is loaded with a tape 4 having coding information, which is read into the computer 1 as soon as the command is inserted into the control panel 3.

Besides coded information for a workpiece receiving device 5 receiving a workpiece 6, the tape 4 carries information about significant points defining a sewing contour to be controlled. For the seam to be produced, these significant points are fed into the computer 1 as X - Y - coordinates, which represent parameters for the algorithm of computation, in order to calculate the remaining points of the contour by applying linear or square interpolation. Moreover, information of special points of the contour are read into the computer 1, as for example, the corners of collar tips, so that, after reaching such significant points the computer logic is capable to branch the program for considering the complicated control operation adjacent to these points. Furthermore, the tape 4 delivers information to the computer 1 for which, at sections of the contour, additionally offered parameters have to be considered. These parameters are considered by the computer 1 in the contour sections as provided by the tape 4.

Figure 4:
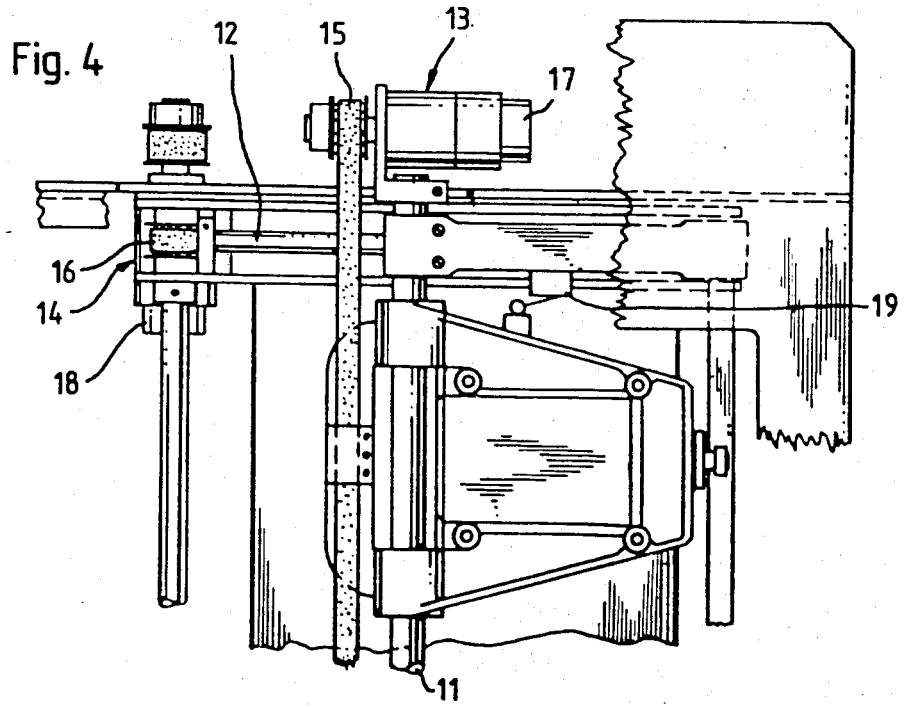
FIG. 4 is a partial top plan view of the automatic sewing machine in the direction of the arrow IV in FIG. 3, without, however, the sewing head.

According to FIG. 1 the automatic sewing machine is provided with a workpiece receiving device 5 secured to a stationary bracket 10 for receiving a workpiece 6. A sewing head 7 defining a part of a sewing machine 8 carries a needle 9 (FIGS. 2 and 3). A relative motion between the needle 9 and the workpiece 6 in a perpendicular plane with respect to the needle motion is obtained by the fact that the sewing machine 8 is movably arranged on two guide bars 11 (X-direction) and 12 (Y-direction), which are horizontally and perpendicularly positioned relative to each other (FIGS. 2, 3 and 4). This movement is performed by associated servo motors 13, 14 via timing belts 15, 16.

The servo motors 13, 14 are equipped with encoders 17, 18 (FIGS. 2 and 4) which are calibrated in cooperation with switches 19, 20 prior to operation of the machine. The switch 19 is associated with the X-axis and the switch 20 with the Y-axis, and accordingly a stationary reference point 39 is defined. After calibration, the encoders 17, 18 steadily pick up the position of the needle 9 relative to the stationary workpiece receiving device 5 in X- and Y-direction. The computer 1 controls the servo motors 13, 14 in such a manner that the sewing machine 8 corresponds to a position controlled by the computer 1 as the needle 9 penetrates the workpiece 6.

In order to feed information about the vertical position of the needle 9 into the computer 1, the sewing machine 8 is provided with a sewing head drive 21 including an encoder 22 (FIG. 3) informing the computer 1 at any time about the position of the needle 9 in conjunction with a zero pulse triggered once per each stroke of the needle 9. The sewing head drive 21 is like the servo motors 13 and 14 controlled by the computer 1 so as to make the needle 9 stitch only into points of the desired contour especially when sewing difficult seam contours having acute-angled passages, e.g. collar tips. With such passages the computer 1 must prevent any deviations of the contour caused by overswinging of the sewing machine 8 moved in X- Y-direction.

The workpiece receiving device 5 includes a supporting plate 25 secured to the stationary bracket 10 by means of screws 23 and pins 24, respectively. The workpiece 6 is clamped onto the supporting plate 25 by a clamping plate 26, the shape of which and that of the supporting plate 25 corresponds with that of the workpiece 6. The pressure of the clamping plates 26 is effected by a clamping device 27 consisting of a lever 29 rotatable about a bolt 28. Between the lever 29 and the stationary bracket 10 there is located an air cylinder 30 effecting the pressing force. The clamping plate 26 is connected to the lever 29 via a swivel bearing 31 fastened to the clamping plate 26 by means of screws 32 and pins 33.

As evident from FIG. 5, a sensor 34 is situated in a lower arm 35 of the sewing head 7. The sensor 34 is freely arranged with respect to the upper surface 36 of the lower arm 35. The sensor 34 is connected to the computer 1 by means of circuits 37.

The supporting plate 25 is provided with a bore 38 serving as a triggering device for the sensor 34 formed as a reflex light barrier. In FIG. 7 there is illustrated a position, in which the sensor 34 is placed below the bore 38, i.e. in a triggering position. As the lower arm 35 is connected to and moved with the sewing head 7, the sensor 34 is firmly associated with the sewing head 7 and thus with the needle 9.

The bore 38 is formed at the mounting base 45 of the supporting plate 25. The mounting base 45 is formed as those of differently contoured workpiece receiving devices with respect to the bores receiving the screws 23 and pins 24.

In FIG. 6 there is illustrated the course of motion of the sewing head 7 or the correspondent course of motion of the sensor 34 installed in the lower arm 35. The servo motors 13, 14 are formed as stepper motors by which the sewing head 7 and the lower arm 35 may be moved along the X/Y-coordinate as illustrated relative to the supporting plate 25.

After switching on the automatic sewing machine, the sewing head 7 moves into such a zero-position, that the sensor 34 is located above the reference point 39. After actuation of a push button (not shown) on the control panel 3, the sewing head 7 controlled by the computer 1 is displaced by a distance A in -Y-direction until the sensor 34 is positioned above a straight line 40, which, in this embodiment, is equally positioned as the center line of the screws 23 and pins 24. After reaching a point 44, the sewing head 7 and the lower arm 35 together with the sensor 34 are moved in -X-direction until the bore 38 is positioned above the sensor 34 as illustrated in FIG. 7. The sensor 34 emits a signal via the circuit 37 to the computer 1. At this instant, the computer 1 locates the relative position, i.e. the X-deflection with respect to the stationary reference point 39. The number of pulses put out by the encoder 17 of the servo motor 13 define an identification code or signal for the workpiece receiving device 5 inserted in the stationary bracket 10. The position of the nearly punctiform bore 38 with respect to the total length of the mounting base 45 of the supporting plate 25 relative to the position of the screws 23 and pins 24 and also relative to the reference point 39, ensures a characterization of the workpiece receiving device 5. The identification code corresponds to the distance B between the point 44 and the bore 38.

When reaching the above described position as also illustrated in FIG. 7, the sewing head 7 stops. Now, the computer 1 checks and compares the number of pulses found when moving along the distance B with the code of program fed by the tape 4. If this examination shows a conformity, the sewing head 7 may be moved into a program starting position by the actuation of a further push button (not shown) provided at the control panel 3. Simultaneously, the needle 9 is positioned on the starting point 41 of the read-in program. Now, the course of the contour read in by the tape 4 may be started. After actuation of a corresponding push button, the sewing head 7 (not sewing) is moved from the starting point 41 to the seam starting point 42. After reaching the seam starting point 42, the sewing machine 8 automatically begins to produce a seam 43 in the workpiece 6.

The bore 38 also may be formed at both sides of the supporting plate 25, so that there will be obtained corresponding left and right starting points, which will be checked correspondingly by the computer 1. This type of embodiment makes possible that, after an exchange of the workpiece receiving device 5, the identification of type of workpiece receiving device is no longer limited to one side, i.e. an idle movement of the sewing head 7 to the other side is not necessary.

While producing a seam 43, there may occur deviations with respect to the real seam contour 43' (FIG. 8) and a theoretically desired seam 43. In order to avoid to start a succeeding seam with such deviation which itself may be of minor extension, and in order to avoid an accumulation of such deviations, there is organized a zero setting procedure carried out in the range of the left seam starting point 42 in conjunction with the aforedescribed stationary reference point 39.

After terminating the seam 43' deviating from the desired seam 43, the sewing head 7 or the lower arm 35 is moved according to the coded program to a point 41', which, in case of no deviation, coincides with the starting point 41 as evident from FIG. 7. Subsequently, the zero setting procedure begins at this point 41'. The sewing head 7 or the lower arm 35 controlled by the computer 1 is at first moved in Y-direction until the switch 20 is actuated. Thus, the movement in Y-direction is interrupted and the associated counter in the computer 1 is set to zero. Now, the sewing head 7 or the lower arm 35 is moved in X-direction until the switch 19 is actuated. In an analogous manner the movement in X-direction is interrupted, so that the sewing head 7 or the lower arm 35 comes to a stop in a firm relation to the stationary reference point 39. Simultaneously, by actuation of the switch 19, the associated counter in the computer 1 is set to zero. For producing a seam 43 the needle 9 of the sewing head 7 now can be moved to the starting point 41, the relative position of which, with respect to the reference point 39, is read in as an address at the beginning of each seam contour to be sewn. This zero setting procedure ensures that the real seam starting point 42 is exactly located at the theoretically desired position.

Figure 8:
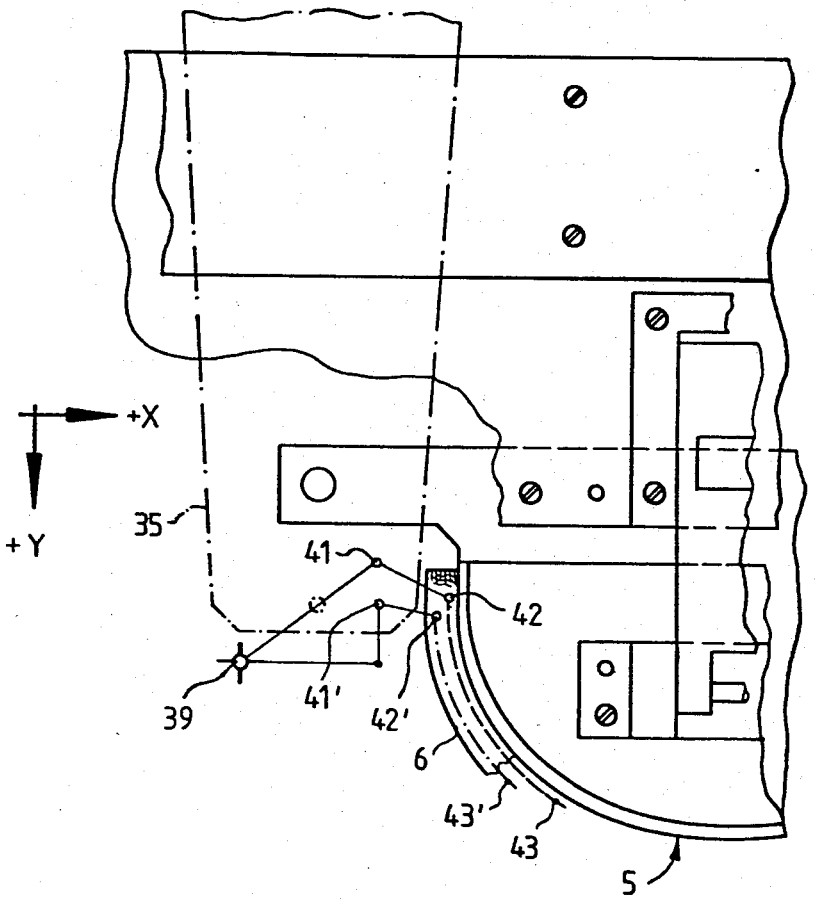
FIG. 8 is a sectional view on an enlarged scale according to FIG. 6 for illustrating the zero setting procedure.

According to the described embodiment, the zero setting procedure preferably is performed after each second seam at the left end of the seam, as illustrated in FIG. 8. Short times for idle movements of the sewing head 7 or the lower arm 35 are obtained by a close arrangement of the points as seam end point 42, starting point 41 and reference point 39 relevant to the zero setting procedure. Thus, short total cycle time rates are achieved.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A method for operating a computer with an automatic sewing machine to operate the sewing machine safely, comprising the steps of:

supplying the computer with a program for controlling a sewing contour to be produced, said program including an identification code;

providing an exchangeable workpiece clamp having a profile and an identification code readable by said computer;

controlling drive motors by said computer for generating said sewing contour within a work area having a firm reference point, said sewing contour representing a relative movement between a needle and said workpiece clamp;

applying a check step prior to a release of operation for comparing said program identification code with said workpiece clamp identification code, and releasing a signal upon an identified matching of said both identification codes;

said check step comprising: transmitting a command by said computer to said motors for controlling a relative check motion between said needle and said profiled workpiece clamp, said check motion being limited by said reference point and a trigger point sensed by sensing means associated to a sewing head having stitch forming means with said needle, the distance between said points corresponding to said workpiece clamp identification code.

2. A method according to claim 1, wherein said check motion includes a relative motion between said needle (9) and said workpiece clamp (5) for rendering possible an unobstructed exchange of the latter.

3. A method according to claim 2, and said computer (1) controlling a succeeding relative motion between said workpiece clamp (5) and said needle (9) for positioning the latter non-sewing on a seam starting point (42) after said signal release.

4. A device for carrying out a method for safe operation of an automatic sewing machine, comprising:

a sewing head (7) including stitch forming means with a needle (9);

a support (10) for receiving an exchangeable workpiece clamp (5) having a profile and identification means (38) corresponding to said profile;

a computer (1) receiving a program for controlling a sewing contour (43) to be produced by said sewing head (7), said program including an identification code;

circuit means for transmitting information about said identification means to said computer (1);

comparison circuit means enclosed in said computer (1) for comparing said identification means (38) with said program identification code for releasing the operation of said automatic sewing machine when matching identification of said profiled workpiece clamp (5) and said program is indicated; and drive means comprising:

motors (13,14) controlled by said computer (1) for generating said sewing contour (43) within a work area formed by two perpendicularly arranged coordinate axes (X; Y), said work area having a reference point (39) firmly placed within the latter and said sewing contour (43) representing a relative movement between said needle (9) and said workpiece clamp (5);

said device comprising: a sensor (34) arranged at said sewing head (7) for sensing said identification means (38) of said profiled workpiece clamp (5), said identification means (38) being punctiformly formed and placed with respect to said reference point (39) at predetermined distance (B) corresponding to said workpiece clamp profile.

5. A device according to claim 4, wherein said sewing head (7) includes a lower arm (35) receiving said sensor (34).

6. A device according to claim 4, wherein said identification means (38) is formed as a bore situated in said profiled workpiece clamp.

7. A device according to claim 4, wherein said identification means (38) is formed as an inductive sensor (34).

8. A device according to claim 4, wherein said identification means (38) comprises a microswitch (-).

9. A device according to claim 4, wherein said identification means (38) is formed by a reflex-light barrier (-).

10. A method for operating a computer with an automatic sewing machine to operate the sewing machine safely, comprising the steps of:

supplying the computer with a program for controlling a sewing contour to be produced, said program including an identification code;

reading with the computer an exchangeable workpiece clamp identification code;

controlling drive motors by said computer for generating said sewing contour within a work area having a firm reference point, said sewing contour representing a relative movement between a needle and the workpiece clamp;

applying a check step prior to a release of operation for comparing said program identification code with said workpiece clamp identification code;

releasing a signal upon an identified matching of said both identification codes; and automatically aligning the position of said computer controlled sewing contour relative to said work area after completion of a sewing contour, said computer controlling an alignment movement relative between said needle and said reference point for bringing both into a coinciding position for generating a subsequent sewing contour beginning at a theoretical start point.

11. A method for operating a computer with an automatic sewing machine to operate the sewing machine safely, comprising the steps of:

providing a workpiece clamp with a profile and a mount base formed with code means corresponding to said profile, said workpiece clamp being fastened to a bracket by fastening means;

moving a carriage in a work area according to a first and a second coordinate direction;

driving said carriage in said coordinate directions independently by drives with motors;

supplying the computer with a program for controlling a sewing contour to be produced in a workpiece received by said workpiece clamp by a sewing head, said program including an identification code and said computer counting pulses by counting means each associated to one of said coordinate directions, said computer comparing said code means with said identification code by comparison means;

forming a stationary reference point within said area by contacting means formed at a frame mounting said bracket and engageable with said carriage;

applying a check step comparing said code means corresponding to said workpiece clamp profile to said program identification code by said comparison means; and releasing a signal at an identified matching of said code means and said identification code;

said check step comprising transmitting a command by said computer for controlling a linear movement of said carriage, said carriage being moved for a distance limited by said reference point and a trigger point provided for said code means of said installed workpiece clamp, sensing said trigger point by sensor means situated at said sewing head and operably connected to said computer, said limited distance corresponding to digital information in said pulse counting means.

12. A method as claimed in claim 11, and aligning automatically the position of said sewing contour relative to said work area after the completion of a sewing contour; controlling by said computer at first one of said motors to cause said carriage to engage one of said contacting means for finding one axis of said reference point and controlling subsequently another one of said motors to cause said carriage to find the other axis of said reference point, and setting thereupon said associated pulse counting means simultaneously to zero; and moving automatically said needle in subsequence to said aligning step onto a position for starting said sewing contour according to said program.

* * * * *